US008708476B2

(12) United States Patent
Sasaki

(10) Patent No.: US 8,708,476 B2
(45) Date of Patent: Apr. 29, 2014

(54) RECORDING APPARATUS

(75) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 206 days.

(21) Appl. No.: 13/326,831

(22) Filed: Dec. 15, 2011

(65) Prior Publication Data

US 2012/0162334 A1 Jun. 28, 2012

(30) Foreign Application Priority Data

Dec. 28, 2010 (JP) ..... 2010-292048

(51) Int. Cl.
*B41J 2/01* (2006.01)
*B41J 29/38* (2006.01)

(52) U.S. Cl.
USPC ..... 347/102; 347/101; 347/104; 347/16; 347/17

(58) Field of Classification Search
USPC ..... 347/16, 17, 101–102, 104
See application file for complete search history.

(56) References Cited

U.S. PATENT DOCUMENTS

| | | | | |
|---|---|---|---|---|
| 6,061,076 | A * | 5/2000 | Ishii et al. | 347/197 |
| 2007/0216731 | A1* | 9/2007 | Koyama et al. | 347/56 |
| 2009/0295894 | A1* | 12/2009 | Hori | 347/102 |
| 2010/0194816 | A1* | 8/2010 | Kanai et al. | 347/16 |

FOREIGN PATENT DOCUMENTS

| | | | |
|---|---|---|---|
| JP | 11-091980 | | 4/1999 |
| JP | 2006-051618 | | 2/2006 |
| JP | 2006051618 | A * | 2/2006 |
| JP | 2009-285877 | | 12/2009 |
| JP | 2009285877 | A * | 12/2009 |

* cited by examiner

*Primary Examiner* — Sarah Al Hashimi
(74) *Attorney, Agent, or Firm* — Workman Nydegger

(57) ABSTRACT

A recording medium includes: a recording head ejecting fluid onto a recording medium; a transporting device transporting the recording medium along a supporting surface; and a heating device heating the recording medium on the supporting surface, in which a control device that protrudes the supporting surface upward toward the center portion from both ends in the width direction perpendicular to the transport direction which is direction the recording medium is transported, and controls the amount of protrusion at the center portion in accordance with the amount of thermal extension in the width direction of the recording medium due to heating of the heating device.

6 Claims, 4 Drawing Sheets

RECORDING APPARATUS

BACKGROUND

This application claims priority to Japanese Patent Application No. 2010-292048, filed Dec. 28, 2010 which is expressly incorporated herein by reference.

1. Technical Field

The present invention relates to a recording apparatus.

2. Related Art

Measures against wrinkling of a recording medium is a problem in recording apparatuses that handle the recording media.

JP-A-2009-285877 discloses a way of preventing wrinkles on a recording medium by suctioning the back of a recording medium under a negative pressure. Further, JP-A-11-91980 discloses a way of preventing wrinkles on a recording medium by operating a transporting roller at an angle.

An ink jet printer has been known as a type of recording apparatus that records images or characters by ejecting fluid onto a recording medium. In the ink jet printer, when ink (fluid) that needs permeation drying or evaporation drying is used, a heating device must be provided to dry the ink ejected on a recording medium. However, thermal extension occurs in the recording medium that is heated by the heating device and the thermal extension appears at the center portion in the width direction, such that wrinkles undulated in the width direction due to twist may be generated. Further, the wrinkles are changed in size by the degree of heating, such that measures against the wrinkles are a problem.

Since the back of a recording medium is suctioned under a negative pressure in JP-A-2009-285877, it is difficult to prevent wrinkles due to thermal extension in the width direction of the recording medium because of the configuration, and since a mechanism, such as a fan or a suction chamber is necessary to make the negative pressure uniform, there is an associated cost.

Further, in JP-A-11-91980, the mechanism and the control for operating the roller at an angle are complicated and it is difficult to cope with the change in size of wrinkles depending on the degree of heating.

SUMMARY

An advantage of some aspects of the invention is to provide a recording apparatus that can prevent a recording medium from being wrinkled by thermal extension in the width direction of the recording medium.

According to an aspect of the invention, there is provided a recording apparatus including: a recording head ejecting fluid onto a recording medium; a transporting device transporting the recording medium along a supporting surface; and a heating device heating the recording medium on the supporting surface, in which a control device that protrudes the supporting surface upward toward the center portion from both ends in the width direction perpendicular to the transport direction which is direction recording medium is transported, and controls the amount of protrusion at the center portion in accordance with the amount of thermal extension in the width direction of the recording medium due to heating of the heating device.

According to this configuration, it is possible to automatically perform control (induction), using gravity such that the thermal extension appears at both width-directional ends by the inclination generated downward toward both ends from the center portion of the supporting surface in the width direction, even though the recording medium is heated on the supporting surface, such that it is possible to prevent wrinkle and twist due to the appearance of the thermal extension at the center portion. Further, since the inclination generated downward can be controlled by the amount of protrusion of the center portion, it is easy to cope with a change in size of wrinkles due to the degree of heating, by controlling the amount of protrusion of the center portion.

Further, the control device may include a converting unit that converts thermal extension generated in a supporting member having the supporting surface by heating of the heating device into the amount of protrusion at the center portion.

According to this configuration, the supporting member having the supporting surface is also heated when the recording medium is heated on the recording surface, such that it is possible to control the amount of protrusion of the center portion of the supporting surface by converting the thermal extension of the supporting member into the amount of protrusion of the center portion such that the amount of protrusion automatically corresponds to the amount of thermal extension of the recording medium.

Further, the converting unit may have a restraining portion that restrains the position of both ends of the supporting member in the width direction.

According to this configuration, it is possible to protrude the center portion such that the supporting member bends when being thermally extended in the width direction by heating, with both ends of the supporting member restrained in the width direction.

Further, the supporting member may have a shape that bends in the transport direction, along a virtual curved line having the center of curvature at the opposite side to where the supporting surface is disposed.

According to this configuration, thermal stress (internal residual stress) is exerted toward the supporting surface when the supporting member is thermally extended by the heating, with both width-directional ends of the supporting member, which has a shape bending in the transport direction, restrained in the width direction, such that it is possible to control deformation such that the supporting surface becomes convex.

Further, the amount of protrusion at the center portion of the supporting surface may be controlled to increase toward the downstream side in the transport direction.

According to this configuration, it is possible to cope with the thermal extension of the recording medium which increases toward the downstream side in the transport direction by heating.

Further, a tension device that applies tension to the recording medium in the transport direction, with a predetermined width including the center portion in the width direction, further to the downstream side in the transport direction than the supporting surface is provided.

According to this configuration, it is possible to press the recording medium against the supporting surface, with a predetermined width including the center portion in the width direction. Therefore, it is possible to increase the operation due to the inclination generated downward toward both ends from the center portion of the supporting surface.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
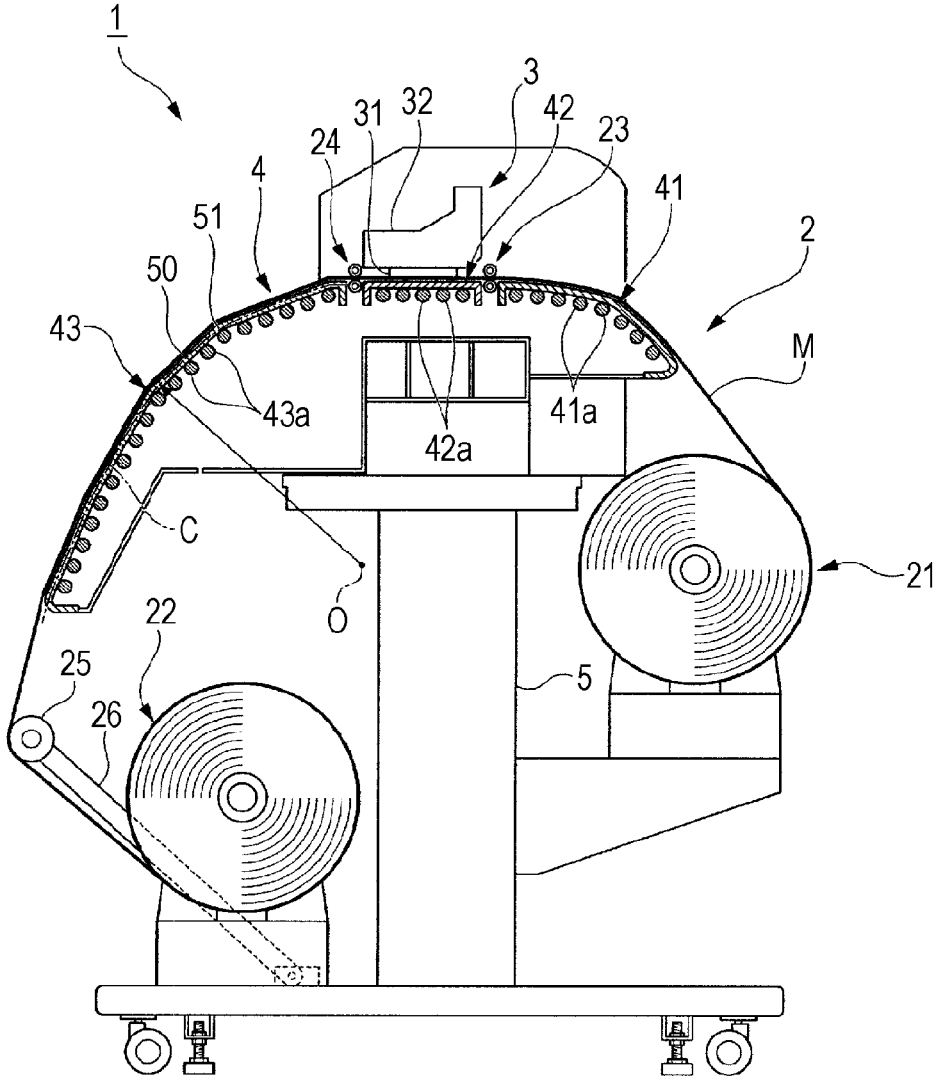
FIG. 1 is a view showing the configuration of a printer according to an embodiment of the invention.

Embodiments of a recording apparatus of the invention are described with reference to the drawings. Further, the scales of the members are appropriately changed such that the members can be recognized, in the drawings used for the following description. An ink jet type printer (hereafter, briefly referred to as a printer) is exemplified in the embodiment as a recording apparatus of the invention.

FIG. 1 is a view showing the configuration of a printer 1 according to an embodiment of the invention.

The printer 1 is a large format printer (LFP) handling relatively large media (recording media) M. The medium M of the embodiment is implemented by a vinyl chloride series having a width of, for example, 64 inches.

As shown in FIG. 1, the printer 1 includes a transporting unit (transporting device) 2 that transports the medium M in a roll-to-roll method, a recording unit 3 that records images or characters by ejecting ink (fluid) onto the medium M, and a heating unit (heating device) 4 that heats the medium M. The units are supported by a main body frame 5.

The transporting unit 2 includes a roll 21 that discharges a rolled medium M and a roll 22 that winds the discharged medium M. The transporting unit 2 includes a pair of transporting rollers 23 and 24 that transport the medium M on a transporting path between the rolles 21 and 22. Further, the transporting unit 2 includes a tension roller (tensing device) 25 that applies tension to the medium M on the transporting path between the paired transporting roller 24 and the roll 22.

The tension roller 25 is supported by an oscillation frame 26, in contact with the rear side of the medium M in the width direction (perpendicular to the page in FIG. 1). The tension roller 25 is formed longer in the width direction than the width of the medium M. The tension roller 25 is disposed further to the downstream side in the transporting direction than the after-heater unit 43 of the heating unit 4, which is described below.

The recording unit 3 includes an ink jet head (recording head) 31 that ejecting ink (fluid) onto the medium M on the transporting path between the pair of transporting rollers 23 and 24 and a carriage that is equipped with the ink jet head 31 and freely reciprocates 32 in the width direction. The ink jet head 31 has a plurality of nozzles and can eject ink that needs permeation drying or evaporation drying, which was selected based on the relationship with the medium M.

The heating unit 4 heats the medium M, thus preventing bleeding and blurring and improves the image quality by rapidly drying and fixing the ink on the medium M. The heating unit 4 has a supporting surface that is a portion of the transporting path of the medium M, and heats the medium M on the supporting surface while bending and supporting the medium M protruding upward between the rolls 21 and 22.

The heating unit 4 includes a preheater unit 41 that preheats the medium M further to the upstream side in the transporting direction from the position where the recording unit 3 is disposed, a platen heater unit 42 that heats the medium M, opposite to the recording unit 3, and an after-heater unit 43 that heats the medium M further to the downstream side in the transporting direction from the position where the recording unit 3 is disposed.

In the embodiment, heating temperature of the heater 41*a* in the preheater unit 41 is set at 40° C. Further, in the embodiment, heating temperature of a heater 42*a* in the platen heater unit 42 is set at 40° C. (the desired treatment), the same as in the heater 41*a*. Further, in the embodiment, heating temperature of a heater 43*a* in the after-heater unit 43 is set at 50° C., higher than that of the heaters 41*a* and 42*a*.

The preheater unit 41 rapidly dries the ink from when the ink lands by gradually increasing the temperature of the medium M to a desired temperature (the temperature of the platen heater unit 42) from room temperature. Further, the platen heater unit 42 allows the ink to land on the medium M with the desired temperature maintained, and encourages the ink to dry rapidly from when the ink lands.

Further, the after-heater unit 43 rapidly dries the remaining ink that lands on the medium M and not dried yet by increasing the temperature of the medium M higher than the desired temperature, and completely dries and fixes the placed ink onto the medium M at least before the medium is wound on the roll 22.

As described above, since the heating temperature of the after-heater unit 43 is set higher than those of other heater units, thermal extension of the medium M is relatively easily generated in comparison to the other heater units. Further, since tension is applied to the medium M by the tension roller 25 in the after-heater unit 43, the thermal extension of the medium M appears at the center portion in the width direction and the medium M is easily twisted and wrinkled.

As a measure, the after-heater unit 43 according to the embodiment has the following configuration.

Figure 2:
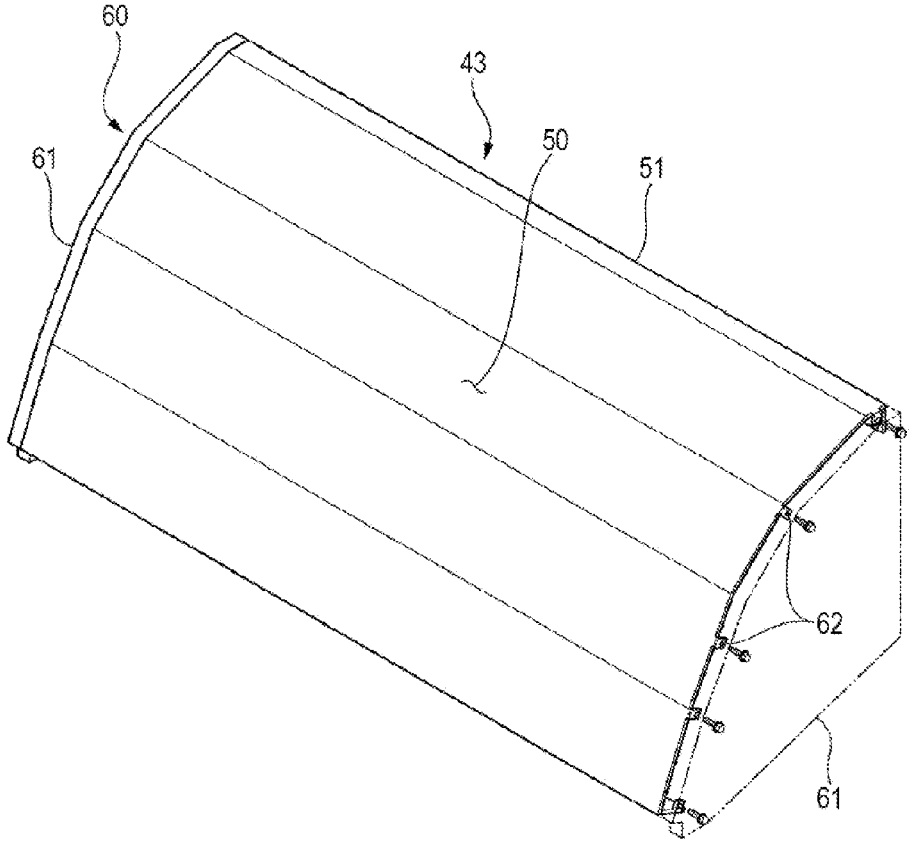
FIG. 2 is a perspective view showing the configuration of an after-heater unit according to an embodiment of the invention.
Figure 3:
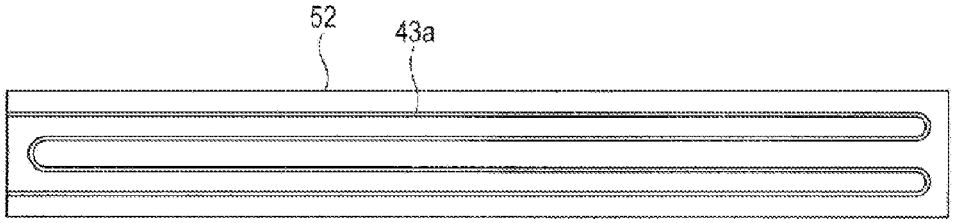
FIG. 3 is a plan view showing the configuration of a heater according to an embodiment of the invention.
Figure 4:
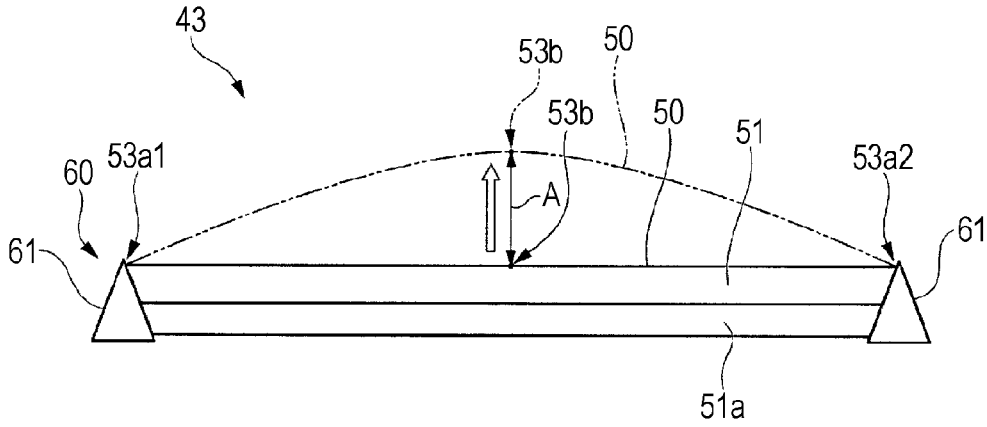
FIG. 4 is a schematic view illustrating the operation of a convexity control portion disposed at the after-heater unit according to an embodiment of the invention.

FIG. 2 is a perspective view showing the configuration of the after-heater unit 43 according to an embodiment of the invention. FIG. 3 is a plan view showing the configuration of the heater 43*a* according to an embodiment of the invention. FIG. 4 is a schematic view illustrating the operation of a convexity control portion 60 disposed at the after-heater unit 43 according to an embodiment of the invention.

As shown in FIG. 2, the after-heater unit 43 has a supporting member 51 having a supporting surface 50 supporting the medium M. The supporting member 51 according to the embodiment is formed of a steel sheet, in more detail, SPCC (cold-rolled steel plate). The supporting member 51 is formed longer in the width direction than the width of the medium M, and more specifically, longer than a width of about 64 inches.

The supporting member 51 has a plurality of bending portions with gaps in the transport direction of the medium M and the entire shape of supporting surface 50 generally and substantially convexly bends. In other words, the supporting member 51 shaped to bend in the transport direction along a virtual curve C (see FIG. 1) with the center O of curvature (see FIG. 1) at the opposite side to where the supporting surface 50 is disposed.

Heaters 43*a*, as shown in FIG. 3 are disposed on the back of the supporting surface 50 of the supporting member 51. The heaters 43*a* according to the embodiment are tube heaters and bonded to the back of the supporting member 51 by an aluminum tape 52. Accordingly, in the embodiment, the heaters

43*a* heats the medium M supported on the supporting surface 50 from the back by transferring heat through the supporting member 51.

As shown in FIG. 4, the after-heater unit 43 has the convex amount control portion (control device) 60 that protrudes the supporting surface 50 upward toward the center portion 53*b* from both ends 53*a*1 and 53*a*2, in the width direction perpendicular to the transport direction in which the medium M is transported and can control the amount of protrusion A at the center portion 53*b* in accordance with the amount of thermal extension in the width direction of the medium M due to heating of the heaters 43*a*.

The convex amount control portion 60 performs control (induction) by using gravity such that the thermal extension of the medium M heated on the supporting surface 50 appears at both width-directional ends by making an inclination downward toward both ends 53*a*1 and 53*a*2 from the center portion 53*b* of the supporting surface 50 in the width direction (indicated by a chain double-dashed line in FIG. 4).

Further, the convex amount control portion 60 can control the amount of protrusion A at the center portion 53*b* in accordance with the amount of thermal extension in the width direction of the medium M, because the optimum value of the amount of protrusion A at the center portion 53*b* for preventing wrinkles on the medium M depends on the material of the medium M, the ink or the heating temperature of the device, the ensured printing width, and the like.

The convex amount control portion 60 according to the embodiment has a restraining portion (converting unit) 61 that restrains the position of both width-directional ends of the supporting member 51 having the supporting surface 50. According to this configuration, it is possible to control the amount of protrusion A of the center portion 53*b* by converting the thermal extension of the supporting member 51 into the amount of protrusion A of the center portion 53*b* such that the amount of protrusion automatically corresponds to the amount of thermal extension of the medium M, because the supporting member 51 having the supporting surface 50 is also heated when the medium M is heated on the supporting surface 50.

As shown in FIG. 2, a pair of restraining portions 61 are positioned with the supporting member 51 therebetween in the width direction. The restraining portions 61 according to the embodiment are formed of steel sheets and have a thickness larger than the thickness of the supporting member 51 such that rigidity and thermal capacity are increased in order not to deform or thermally extend in the width direction integrally with the supporting member 51, even if heat is transferred to the supporting member 51.

Further, in the embodiment, fastening-fixing portions (heat-transferring portions) 62 with which the supporting member 51 and the restraining portions 61 are in contact are attached with a gap in the transport direction, such that heat is difficult to be transferred from the supporting member 51 to the restraining unit 61.

Further, as a part that restrains the supporting member 51, a part implemented by using a non-deformable material (a material with a higher rigidity or a material with a small linear coefficient of expansion) for the material of the restraining portion 61 and a part that rigidly fixes the restraining portion 61 to the main body frame 5.

Figure 5:
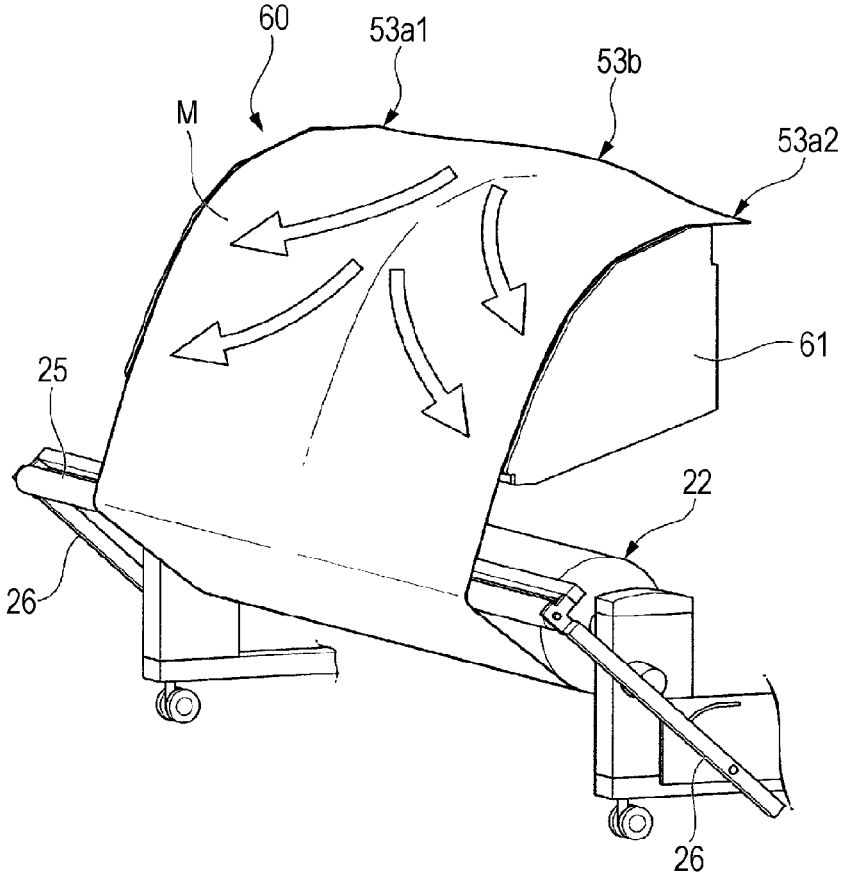
FIG. 5 is a view illustrating the operation of preventing wrinkles on a medium according to an embodiment of the invention.

Next, the operation preventing wrinkles on the medium M is described further with reference to FIG. 5.

FIG. 5 is a view illustrating the operation of preventing wrinkles on the medium M according to an embodiment of the invention.

As the heaters 43*a* of the after-heater unit 43 are driven, the supporting member 51 is heated up to a predetermined temperature (50° C. in the embodiment) from room temperature. Since the position of both ends in the width direction of the supporting member 51 is restrained by the restraining portions 61, it is possible to protrude the center portion 53*b* of the supporting surface 50 such that the supporting member 51 bends when being thermally extended in the width direction by the heating (see FIG. 4).

Further, in the embodiment, since the supporting member 51 has a shape bending in the transport direction, thermal stress (internal residual stress) is exerted toward the supporting surface 50 when the supporting member 51 is thermally extended in the width direction by the heating, with the supporting member 51 restrained in the width direction by the restraining portions 61, and thus, it is possible to control deformation such that the supporting surface 50 becomes convex. Therefore, it is possible to prevent an unexpected side (the opposite side to the supporting surface 50) from convexly deforming.

As described above, since the restraining portions 61 protrudes the supporting surface 50 upward toward the center potion 53*b* from both ends 53*a*1 and 53*a*2 in the width direction perpendicular to the transport direction in which the medium M is transported, it is possible to generate a downward inclination toward both ends 53*a*1 and 53*a*2 from the center portion 53*b* of the supporting surface 50 in the width direction.

Therefore, as shown in FIG. 5, it is possible to perform control (induction) by using gravity such that the thermal extension appears at both width-directional ends of the medium M, even though the medium M is heated on the supporting surface 50, such that it is possible to prevent wrinkle and twist due to the appearance of the thermal extension at the width-directional center portion of the medium M. Further, the medium M where tension is applied in a predetermined width, including the center portion 53*b* in the width direction by the tension roller 25 is forced against the supporting surface 50. Therefore, the induction can be increased by the inclination generated toward both ends 53*a*1 and 53*a*2 from the center potion 53*b* of the supporting surface 50.

Further, in the embodiment, since the amount of protrusion A at the center portion 53*b* is controlled in accordance with the thermal extension in the width direction of the medium M due to heating from the heaters 53*a*, it is possible to cope with changes in size of wrinkles of the medium M due to the degree of heating. In detail, the amount of protrusion A at the center portion 53*b* is controlled within the range of 0.5 mm to 1.5 mm under the heating conditions described above in the embodiment. Accordingly, it is possible to achieve the effect of preventing wrinkles from being generated, in a medium M having a width to the extent of 64 inches. Further, it is possible to suppress the adverse effect in transport of a medium having a small width that does not influence the center portion 53*b* by the control within the range.

Further, in the embodiment, it is possible to control the amount of protrusion A at the center portion 53*b* of the supporting surface 50 by employing the configuration of converting the thermal extension due to heating of the supporting member 51 having the supporting surface 50 into the amount of protrusion A at the center portion 53*b* by using the restraining portions 61 such that the amount of protrusion A at the center portion 53*b* of the supporting surface 50 automatically corresponds to the amount of thermal extension of the medium M. For example, when the medium M is heated at a temperature higher than 50° C. (for example, 60° C.), the amount of thermal extension in the width direction of the medium M and the amount of protrusion A at the center portion 53*b* increase in accordance with the temperature, such that it is possible to increase induction due to the inclination in accordance with the temperature by increasing the inclination generated downward toward both ends 53*a*1 and 53*a*2 from center portion 53*b*.

Therefore, according to the embodiment described above, in the printer 1 including the ink jet head 31 ejecting ink onto the medium M, the transporting unit 2 transporting the medium M along the supporting surface 50, and the after-heater unit 43 heating the medium M on the supporting surface 50, by employing the configuration that protrudes the supporting surface 50 upward toward the center portion 53*b* from both ends 53*a*1 and 53*a*2 in the width direction perpendicular to the transport direction in which the medium M is transported and has the convex amount control portion 60 that can control the amount of protrusion A at the center portion 53*b* in accordance with the amount of thermal extension in the width direction of the medium M heated by the heaters 53*a*, it is possible to automatically perform control (induction), using gravity such that the thermal extension appears at both width-directional ends by the inclination generated downward toward both ends 53*a*1 and 53*a*2 from the center portion 53*b* of the supporting surface 50 in the width direction, even though the medium M is heated on the supporting surface 50, and accordingly, it is possible to prevent wrinkle and twist due to the appearance of the thermal extension in the width direction at the center portion. Further, since the inclination generated downward can be controlled by the amount of protrusion A of the center portion 53*b*, it is easy to cope with a change in size of wrinkles due to the degree of heating, by controlling the amount of protrusion A of the center portion 53*b*.

Accordingly, in the embodiment, it is possible to prevent wrinkles from being generated by the thermal extension in the width direction of the medium M and it is also possible to cope with a change in size of wrinkles due to the degree of heating.

Although preferred embodiments of the invention were described above with reference to the drawings, the invention is not limited to the embodiment. The shapes or the combination of the components shown in the embodiment are an example and they may be changed in various ways on the basis of the desired design without departing from the spirit of the invention.

Figure 6:
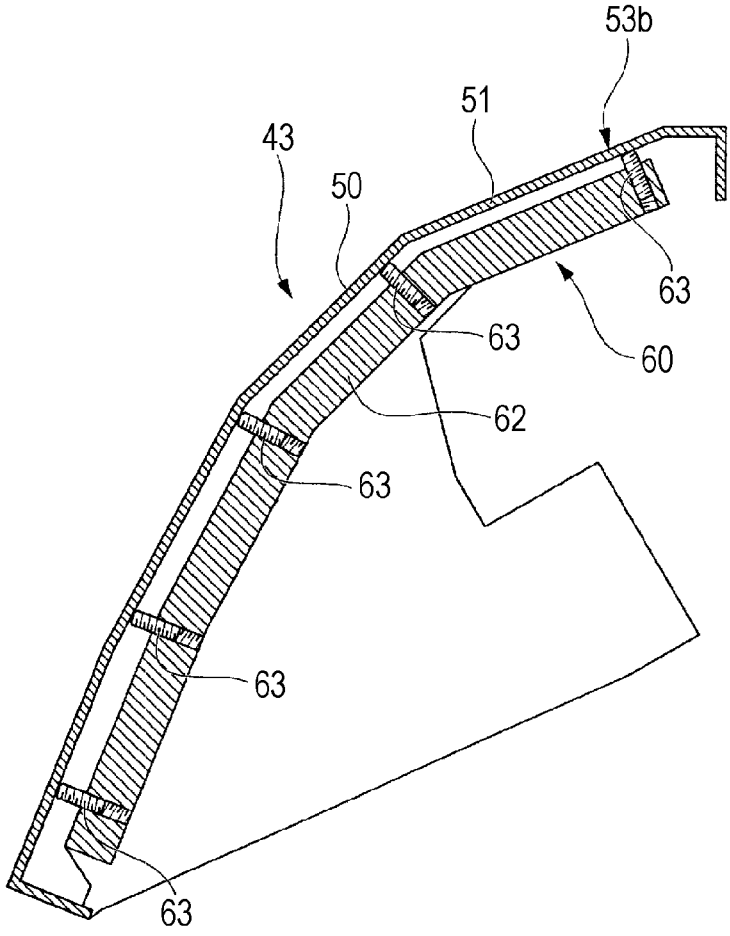
FIG. 6 is a cross-sectional view showing the configuration of a convexity control portion according to another embodiment of the invention.

For example, although the configuration in which the convex amount control portion 60 thermally controls the amount of protrusion A at the center portion 53*b* by the thermal extension of the supporting member 51 is described in the embodiment, as shown in FIG. 6, a configuration that physically controls the amount of protrusion A at the center portion 53*b* may be possible.

FIG. 6 is a cross-sectional view showing the configuration of the convex amount control portion 60 according to another embodiment of the invention. Further, FIG. 6 is a cross-sectional view taken along the center portion 53*b*, in which the heaters 43*a* are not shown.

As shown in the figure, a beam member 62 is disposed on the opposite side to where the supporting surface 50 of the supporting member 51 is disposed and a plurality of setscrews 63 is tightened in the beam member 62, with gaps in the transport direction. The beam member 62 is disposed at the width-directional center portion of the supporting member 51. According to this configuration, it is possible to control the amount of protrusion of the center portion 53*b* of the supporting surface 50 by controlling the amount of tightening of the setscrews 63.

Further, as shown in FIG. 6, it is possible to appropriately cope with the thermal extension of the medium M which increases toward the downstream side in the transport direction by heating, by controlling the amount of protrusion at the center portion 53*b* of the supporting surface 50 to be increased toward the downstream side in the transport direction.

Further, it is also possible to achieve the same effect as that described above in the embodiment by implementing the supporting surface 50 from a plurality of members having different linear coefficients of expansion in order to increase the linear coefficient of expansion toward the downstream side in the transport direction.

Further, for example, although it is exemplified in the embodiment when the convex amount control portion 60 is disposed at the after-heater unit 43 that has a large area of contact with the medium M in the transport path and effectively prevents wrinkles, it may be disposed at another portion (for example, the preheater unit 41).

In the embodiment, although it is exemplified when the recording apparatus is the printer 1, the recording apparatus is not limited to printers and may be a copy machine or a facsimile or the like.

Further, a recording apparatus that ejects or discharges another fluid, other than ink, may be employed as the recording apparatus. The invention may be used for various recording apparatuses including a recording head that discharges a small amount of droplets, for example. Further, droplets mean the state of fluid discharged from the recording apparatus, including a particle shape, a tear shape, and ones with a string-shaped tail. Further, the fluid should be a material that the recording apparatus can eject. For example, the material should be in a liquid state, like a fluid state such as: fluid with high or low viscosity, sol, gel water, other inorganic solvents, organic solvents, solution, liquid-state resin, liquid-state metal (metallic melt), including not only liquid as one state of the material, but a substance where particles of a functional material made of solid materials, such as a colorant or metal particles are dissolved, dispersed, or mixed in a solvent. Further, the ink described in the embodiment may be a typical example of the fluid. The ink includes various fluid compounds, such as common aqueous ink, oil-based ink, gel ink, and hot-melt ink. Further, the recording medium includes functional paper, substrate, and metal plate, other than plastic films, such as a vinyl chloride series-based film.

What is claimed is:

1. A recording apparatus comprising:

a recording head ejecting fluid onto a recording medium; a transporting device transporting the recording medium along a supporting surface; and a heating device heating the recording medium on the supporting surface, wherein the supporting surface protrudes upward toward the center portion from both ends, in the width direction perpendicular to a transport direction which is direction the recording medium is transported, wherein the recording apparatus further comprises a control device that controls the amount of protrusion at the center portion in accordance with the amount of thermal extension in the width direction of the recording medium due to heating of the heating device.

2. The recording apparatus according to claim 1, wherein the control device includes a converting unit that converts thermal extension generated in a supporting member having the supporting surface by heating of the heating device into the amount of protrusion at the center portion.

3. The recording apparatus according to claim 2, wherein the converting unit has a restraining portion that restrains the position of both ends of the supporting member in the width direction.

4. The recording apparatus according to claim 3, wherein the supporting member has a shape that bends in the transport direction, along a virtual curved line having the center of curvature at the opposite side to where the supporting surface is disposed.

5. The recording apparatus according to claim 1, wherein the amount of protrusion at the center portion of the supporting surface is controlled to increase toward the downstream side in the transport direction.

6. The recording apparatus according to claim 1, further comprising a tension device that applies tension to the recording medium in the transport direction, with a predetermined width including the center portion in the width direction, further to the downstream side in the transport direction than the supporting surface.

* * * * *